US006984091B2

(12) United States Patent
Maltby

(10) Patent No.: US 6,984,091 B2
(45) Date of Patent: Jan. 10, 2006

(54) YIELDING ROCK BOLT

(75) Inventor: David Maltby, Canningvale (AU)

(73) Assignee: Garford Pty Ltd., Wangara (AU)

( * ) Notice: Subject to any disclaimer, the term of this patent is extended or adjusted under 35 U.S.C. 154(b) by 0 days.

(21) Appl. No.: 10/488,676

(22) PCT Filed: Sep. 6, 2002

(86) PCT No.: PCT/AU02/01223

§ 371 (c)(1),
(2), (4) Date: Sep. 2, 2004

(87) PCT Pub. No.: WO03/021081

PCT Pub. Date: Mar. 13, 2003

(65) Prior Publication Data

US 2005/0042037 A1 Feb. 24, 2005

(30) Foreign Application Priority Data

Sep. 6, 2001 (AU) ..... PR7519
Aug. 6, 2002 (AU) ..... 2002950586

(51) Int. Cl.
*E21D 21/02* (2006.01)

(52) U.S. Cl. ..... 405/259.1; 405/259.4; 405/259.5; 52/155; 411/82; 411/258

(58) Field of Classification Search ..... 405/258.1, 405/259.1–6; 52/155, 165; 411/82, 258, 411/930

See application file for complete search history.

(56) References Cited

U.S. PATENT DOCUMENTS

| | | | | |
|---|---|---|---|---|
| 3,967,455 | A * | 7/1976 | Conway | 405/288 |
| 5,259,703 | A * | 11/1993 | Gillespie | 405/259.6 |
| 5,531,545 | A * | 7/1996 | Seegmiller et al. | 405/259.4 |
| 5,556,233 | A * | 9/1996 | Kovago | 405/259.4 |
| 5,586,839 | A * | 12/1996 | Gillespie | 405/259.1 |
| 5,785,463 | A * | 7/1998 | Eaton et al. | 405/259.5 |
| 5,919,006 | A * | 7/1999 | Calandra et al. | 405/259.5 |
| 5,954,455 | A * | 9/1999 | Eaton et al. | 405/259.6 |
| 6,390,735 | B1 * | 5/2002 | Gaudreau et al. | 405/259.6 |
| 6,402,433 | B1 * | 6/2002 | Gillespie | 405/259.1 |
| 6,428,243 | B1 * | 8/2002 | Hutchins | 405/259.1 |
| 6,527,482 | B1 * | 3/2003 | Stankus | 405/259.5 |
| 2002/0110426 | A1 * | 8/2002 | Stankus et al. | 405/259.5 |

FOREIGN PATENT DOCUMENTS

| | | |
|---|---|---|
| AU | 59356/98 | * 10/1999 |
| GB | 2202600 | * 9/1988 |
| WO | 9811324 | * 3/1998 |

* cited by examiner

*Primary Examiner*—Jong-Suk (James) Lee
(74) *Attorney, Agent, or Firm*—Bachman & LaPointe, P.C.

(57) ABSTRACT

A yielding rock bolt arranged to be inserted into a hole in a rock surface. The rock bolt comprises a shaft having a widened portion adjacent a first end thereof, arranged, in use, adjacent an inner end of the hole. The rock bolt also includes an anchor member arranged to be secured within the hole in the rock surface. A longitudinal bore is provided in the anchor member to receive a second end of the shaft, the longitudinal bore being of a diameter slightly less than that of the widened portion of the shaft. A rock face engaging means is provided adjacent a second end of the shaft to secure the second end of the shaft adjacent the rock face. Movement of the rock face causes the widened portion of the shaft to be pulled through the longitudinal bore in the anchor member.

12 Claims, 2 Drawing Sheets

YIELDING ROCK BOLT

FIELD OF THE INVENTION

Seismic disturbances in underground mines are common. The forces involved in such disturbances can cause the tunnels of these underground mines to collapse and the use of rock bolts to prevent catastrophic collapse of the tunnel walls is known. The rock bolts are secured into holes drilled in tunnel walls and are designed to yield to a certain extent to prevent collapse of the tunnel walls. The movement which occurs as the rock bolt yields then provides warning to persons in the mine of possible collapse of the tunnel.

SUMMARY OF THE INVENTION

In accordance with one aspect of the present invention there is provided a yielding rock bolt arranged to be inserted into a hole in a rock surface characterised by comprising:

a shaft having a widened portion adjacent a first end thereof, the first end being arranged, in use, adjacent an inner end of the hole;

an anchor member arranged to be secured within the hole in the rock surface;

a longitudinal bore provided in the anchor member, the longitudinal bore being arranged to receive a second end of the shaft and being of a diameter less than that of the widened portion of the shaft; and a rock face engaging means adjacent a second end of the shaft to secure the second end of the shaft adjacent the rock face; wherein movement of the rock face causes the widened portion of the shaft to be pulled through the longitudinal bore in the anchor member.

DESCRIPTION OF THE DRAWINGS

The present invention will now be described, by way of example, with reference to the accompanying drawings, in which.

DESCRIPTION OF THE INVENTION

Figure 1:
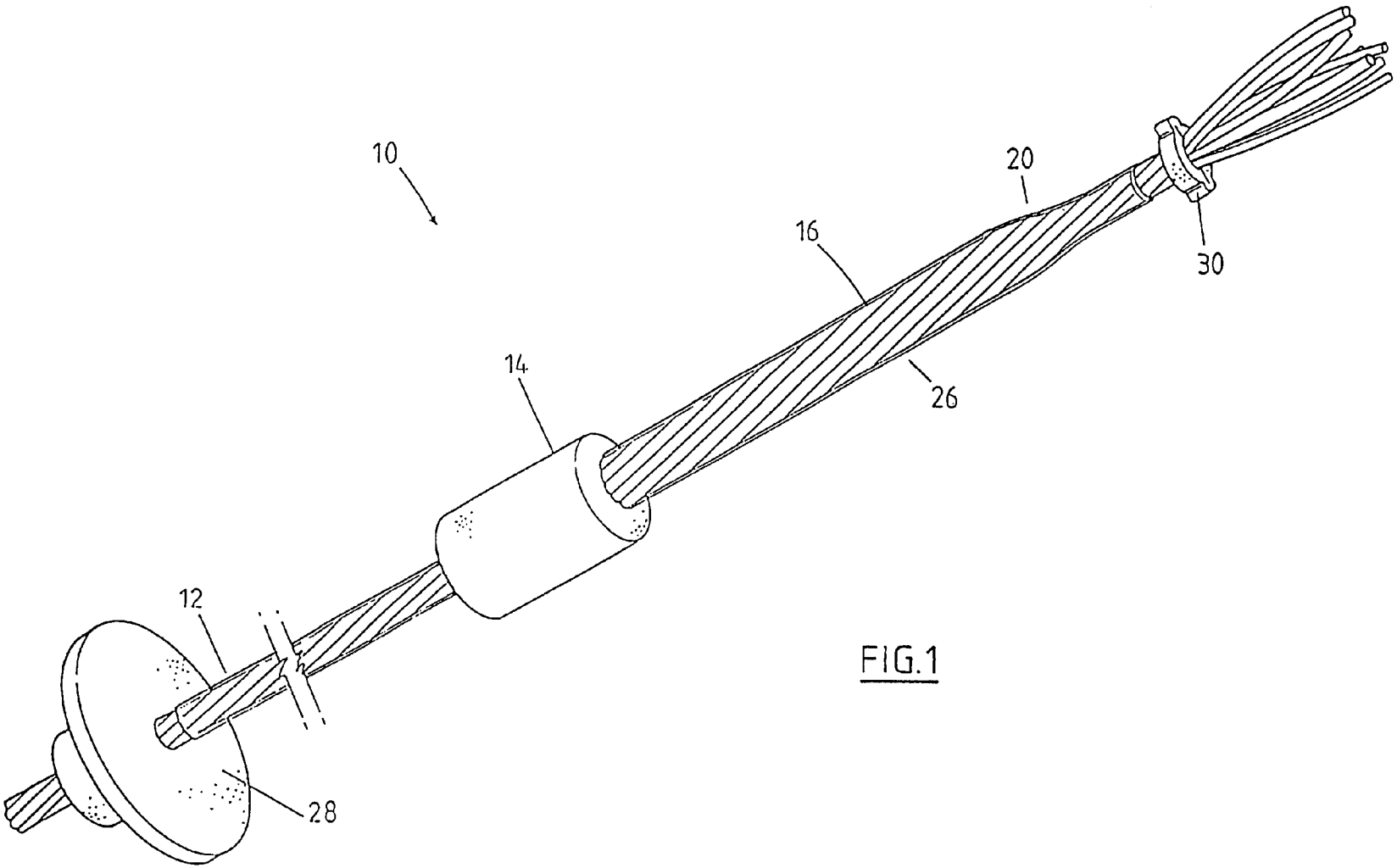
FIG. 1 is a perspective view of a yielding rock bolt in accordance with the present invention.
Figure 2:
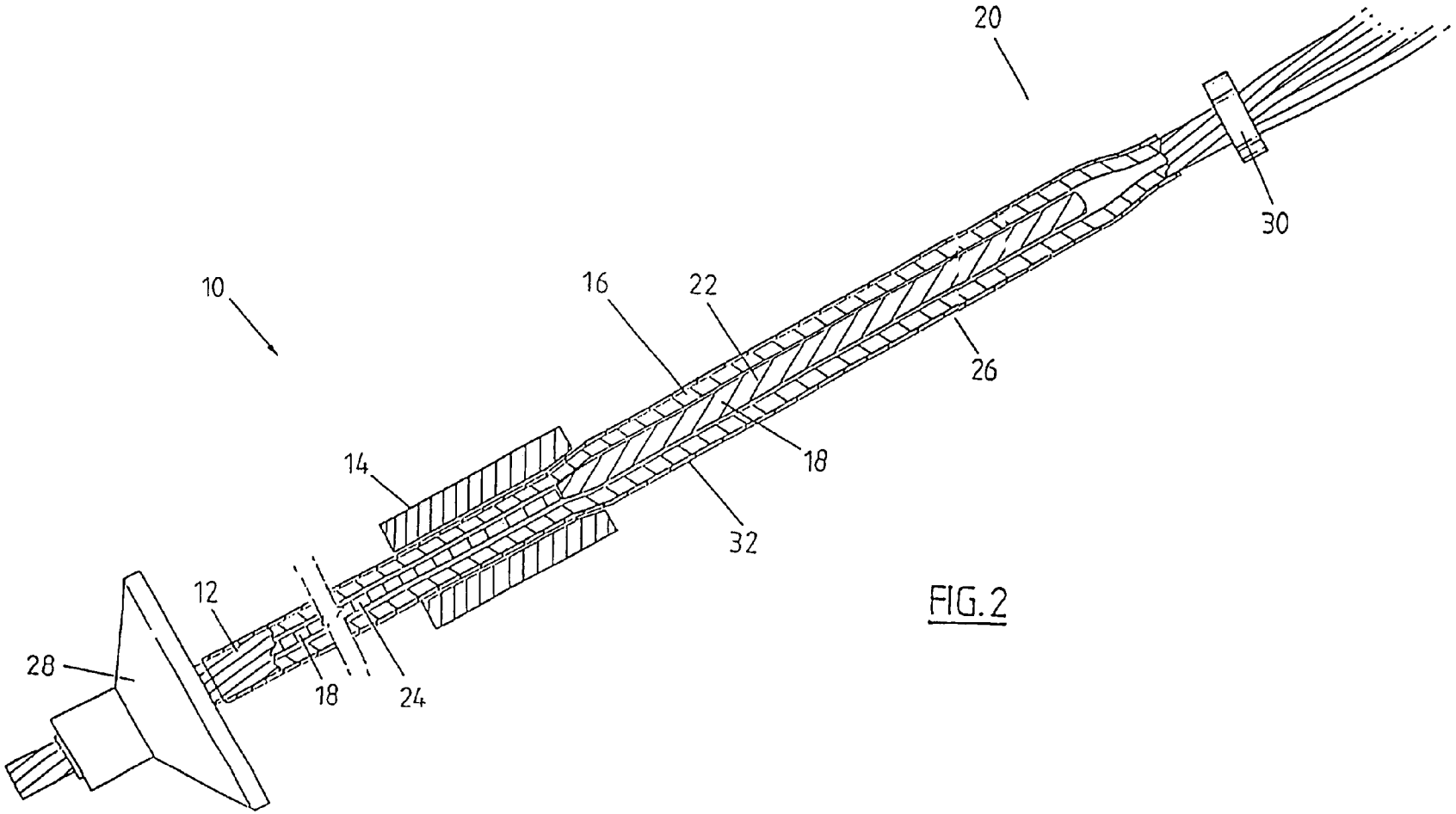
FIG. 2 is a cross sectional view of the rock bolt of FIG. 1.

Referring to the Figures, there is shown a yielding rock bolt 10 comprising a shaft 12 and an anchor member 14. The shaft 12 comprises a plurality of peripheral cable strands 16 spirally wrapped around a centre wire 18 (commonly referred to as a 'king wire').

The centre wire 18 may comprise more than one sections and includes a segment having an increased diameter adjacent a first end 20 thereof. The centre wire 18 of the rock bolt 10 shown in the Figures comprises a first centre wire 22 adjacent the first end 20 and a second centre wire 24 extending from the first centre wire 22 to a second end of the shaft 12. The second centre wire 24 is of a diameter generally equal to that of the peripheral cable strands 16. The first centre wire 22 has a diameter greater than that of the second centre wire 24 such that the shaft has a widened portion 26 adjacent the first end 20 thereof.

The anchor member 14 includes a longitudinal bore such that the shaft 12 is receivable in the longitudinal bore. The diameter of the longitudinal bore is arranged to be slightly less than that of the widened portion 26. The first centre wire 22 and internal surfaces of the longitudinal bore of the anchor member 14 may be of a material that is softer than that of the peripheral cable strands 16. The peripheral cable strands 16, the first and second centre wires 22 and 24 and anchor member 14 in this case will generally be made of steel with the first centre wire 22 and the anchor member 14 being of a softer steel than the second centre wire 24 and the peripheral cable strands 16.

The softer material of the first centre wire 22 and internal surfaces of the longitudinal bore of the anchor member 14 allow the first centre wire 22 and internal surfaces to deform as the shaft 12 is pulled through the anchor member 14. Alternatively, if the first centre wire 22 and internal surfaces of the longitudinal bore are not constructed of a softer material then a first centre wire 22 of a slightly smaller diameter will be required.

The longitudinal bore may include an outwardly tapered portion at an end arranged adjacent the widened portion 26 in use. Further, the internal surfaces of the longitudinal bore will preferably be metallurgically treated, such as nitrocarburised to prevent molecular welding to the shaft 12 as the shaft 12 is drawn through the anchor member 14.

The rock bolt 10 also includes a rock-face engaging means 28 adjacent the second end of the shaft 12. The rock face engaging means 28 as shown in the Figures is in the form of a generally conical shaped plate member. The plate member is arranged such that when the rock bolt 10 is inserted into a hole drilled into the tunnel wall with the first end 20 of the shaft 12 entering the hole first, the plate member engages with the rock face around the hole.

The rock bolt 10 further includes a clamp member 30 adjacent the first end 20 of the shaft 12. The clamp member 30 holds the peripheral cable strands 16 together and the peripheral cable strands 16 are preferably splayed outwardly at the first end 20 of the shaft 12. The splayed peripheral cable strands 16 may engage with internal surfaces of the hole when the rock bolt 10 is inserted into the hole, to hold the rock bolt 10 in the hole until it is secured with grout in a known manner. The shaft 12 is also provided with a de-bonding sheath 32 along the length of the shaft 12. The de-bonding sheath 32 causes the shaft 12 to not bond with the grout so that the shaft 12 is slidable within the grout while the anchor member 14 is secured in place by the grout.

Further, the centre wire may also include an end segment adjacent the first end 20 (not shown) of diameter greater than the first centre wire 22. The end segment is of a diameter whereby the resulting diameter of the shaft 12 around the end segment is such that the shaft 12 cannot pass through the longitudinal bore of the anchor member 14. Thus when the shaft 12 has been pulled through the anchor member 14 until the anchor member 14 approaches the end segment, the portion of the shaft 12 around the end segment will seize against the anchor member 14 allowing the rock bolt 10 to achieve its maximum load.

In use, a hole is drilled into the wall of a tunnel and the first end 20 of the rock bolt 10 is inserted into the hole until the plate member adjacent the second end of the shaft 12 engages with the rock face around the hole. The anchor member 14 is located around the shaft 12 adjacent an end of the widened portion 26 remote from the first end 20 of the shaft 12.

The hole around the rock bolt 10 is then filled with grout in a known manner. The anchor member 14 is secured in place by the grout while the shaft 12 may to slide within the hole due to the presence of the de-bonding sheath 32.

If movement of the rock around the rock bolt 10 causes a portion of the rock face to begin to break away, the portion of the rock face is held in place by rock bolt 10 being secured at the anchor member 14. The movement however, will cause the widened portion 26 of the shaft 12 to be pulled through the anchor member 14. The rock bolt 10 therefore yields as the rock face moves, reducing the possibility of sudden failure of the rock face. In the case where softer steel is used for the centre wire 22 the softer steel will allow the internal surfaces of the longitudinal bore in the anchor member 14 and the first centre wire 22 to deform as the shaft 12 is pulled through the anchor member.

It will be appreciated that while the present invention has been described with reference to a rock bolt comprising a plurality of peripheral cable strands, the invention could also be applied to a solid type rock bolt.

Modifications and variations as would be apparent to a skilled addressee are deemed to be within the scope of the present invention.

What is claimed is:

1. A yielding rock bolt arranged to be inserted into a hole in a rock surface comprising:

a shaft having a widened portion adjacent a first end thereof, the first end being arranged, in use, adjacent an inner end of the hole;

an anchor member arranged to be secured within the hole in the rock surface;

a longitudinal bore provided in the anchor member, the longitudinal bore being arranged to receive a second end of the shaft and being of a diameter less than that of the widened portion of the shaft; and a rock face engaging means adjacent the second end of the shaft to secure the second end of the shaft adjacent the rock face:

wherein movement of the rock face causes the widened portion of the shaft to be pulled through the longitudinal bore in the anchor member.

2. A yielding rock bolt in accordance with claim 1, wherein the shaft comprises a plurality of peripheral cable strands spirally wrapped around a centre wire, the centre wire including a first segment adjacent the first end of the shaft and a second segment extending from the first segment toward the second end of the shaft, wherein the first segment has a diameter greater than the second segment such that the first segment causes the peripheral cable strands to be forced outwardly, thus creating the widened portion of the shaft.

3. A yielding rock bolt in accordance with claim 2, wherein the diameter of the second centre wire segment is generally equal to the diameter of the peripheral cable strands.

4. A yielding rock bolt in accordance with claim 3, wherein the first segment of the centre wire is constructed of a material softer than the peripheral cable strands such that the first segment of the centre wire is deformed as the widened portion of the shaft is pulled through the longitudinal bore of the anchor member.

5. A yielding rock bolt in accordance with claim 4, wherein the centre wire includes a third segment adjacent the second end of the shaft, the third segment of the centre wire having a diameter greater than that of the first segment such that the longitudinal bore of the anchor member is not able to slide over the portion of the shaft around the third segment of the centre wire.

6. A yielding rock bolt in accordance with claim 5, wherein inner surfaces of the longitudinal bore are constructed of a material softer than the shaft such that the inner surfaces of the longitudinal bore are deformed as the widened portion of the shaft is pulled through the longitudinal bore of the anchor member.

7. A yielding rock bolt in accordance with claim 6, wherein inner surfaces of the longitudinal bore are metallurgically treated to prevent molecular welding to the shaft.

8. A yielding rock bolt in accordance with claim 7, wherein the metallurgical treatment includes nitrocarburising.

9. A yielding rock bolt in accordance with claim 8, wherein the longitudinal bore of the anchor member includes an outwardly tapered portion adjacent a first end of the anchor member, the first end of the anchor member being adjacent, in use the widened portion of the shaft.

10. A yielding rock bolt in accordance with claim 2, wherein the peripheral cable strands are secured together adjacent the first end of the shaft by a clamp member and the peripheral cable strands are splayed outwardly at the first end of the shaft to engage with side walls of the hole in the rock.

11. A yielding rock bolt in accordance with claim 1, wherein the shaft is provided with a de-bonding sheath to allow the shaft to slide within the hole in the rock.

12. A yielding rock bolt in accordance with claim 1, wherein the rock face engaging means comprises a conical shaped plate member.

* * * * *